United States Patent [19]

Simmons

[11] 4,170,539

[45] Oct. 9, 1979

[54] DIAPHRAGM HAVING ZIRCONIUM OXIDE AND A HYDROPHILIC FLUOROCARBON RESIN IN A HYDROPHOBIC MATRIX

[75] Inventor: Robert B. Simmons, Norton, Ohio

[73] Assignee: PPG Industries, Inc., Pittsburgh, Pa.

[21] Appl. No.: 953,133

[22] Filed: Oct. 20, 1978

[51] Int. Cl.[2] ..... C25B 13/00; C25B 13/04; C25B 13/06; C25B 13/08

[52] U.S. Cl. ..... 204/295; 204/296; 521/27

[58] Field of Search ..... 204/295, 296, 252, 253, 204/301; 521/27, 28

[56] References Cited

U.S. PATENT DOCUMENTS

| | | | |
|---|---|---|---|
| 1,942,183 | 1/1934 | Muller | 204/28 |
| 2,661,288 | 12/1953 | Barbaras | 92/21 |
| 3,056,647 | 10/1962 | Amphlett | 23/14.5 |
| 3,479,266 | 11/1969 | Rajan et al. | 204/295 X |
| 3,479,267 | 11/1969 | Rajan et al. | 204/295 X |
| 3,541,030 | 11/1970 | Boies et al. | 521/27 |
| 3,702,267 | 11/1972 | Grot | 204/295 X |
| 3,703,413 | 11/1972 | Arrance | 136/6 |
| 4,032,427 | 6/1977 | Kadija | 204/295 X |
| 4,089,758 | 5/1978 | McAloon | 204/98 |
| 4,120,772 | 10/1978 | Kadija | 204/295 X |

*Primary Examiner*—Arthur C. Prescott
*Attorney, Agent, or Firm*—Richard M. Goldman

[57] ABSTRACT

Disclosed is a diaphragm having a porous, hydrophobic fluorocarbon matrix, an intermediate layer or film of a hydrophilic fluorocarbon resin on the surfaces of the matrix, and a hydrous oxide of zirconium contained in the void volumes of the matrix. The layer of the hydrous oxide of zirconium may also contain MgO.

10 Claims, No Drawings

DIAPHRAGM HAVING ZIRCONIUM OXIDE AND A HYDROPHILIC FLUOROCARBON RESIN IN A HYDROPHOBIC MATRIX

Alkali metal chloride brines, such as potassium chloride brines and sodium chloride brines, may be electrolyzed in a diaphragm cell to yield chlorine, hydrogen, and aqueous alkali metal hydroxide. In a diaphragm cell, brine is fed to the anolyte compartment and chlorine is evolved at the anode. Electrolyte from the anolyte compartment percolates through an electrolyte permeable diaphragm to the catholyte compartment where hydroxyl ions and hydrogen gas are evolved.

Previously, the diaphragm has been provided by fibrous asbestos deposited on an electrolyte permeable cathode. However, environmental and economic considerations now suggest a more longer-lived, less environmentally hazardous diaphragm. One such diaphragm is a synthetic polymeric diaphragm between the anolyte compartment and the catholyte compartment of the cell.

One satisfactory diaphragm is a diaphragm having a porous polymeric matrix with a hydrous oxide of zirconium contained within the matrix. This diaphragm may be prepared by contacting and preferably saturating a porous polymeric matrix with a zirconium compound whereby to preferably fill the porous matrix with the zirconium compound and converting the zirconium compound to an oxide, for example, by hydrolysis.

It has now been found that the provision of a hydrophilic resin on the matrix surfaces provides long-lived diaphragms of enhanced electrolytic properties. Especially preferred is a diaphragm having a porous, hydrophobic fluorocarbon matrix, an intermediate layer or film of the hydrophilic fluorocarbon resin on the hydrophobic matrix surface, and an outer layer of the hydrous oxide of zirconium preferably filling the remaining void volume of the porous matrix. The outer layer may also contain magnesium oxide. The preferred hydrophilic fluorocarbon resins are perfluorinated hydrocarbons having pendant acid groups. The diaphragm herein contemplated may be prepared by first depositing a hydrophilic fluorocarbon resin on the surfaces of the porous, hydrophobic, fluorocarbon matrix and thereafter contacting, and preferably filling, the porous fluorocarbon matrix with a suitable zirconium compound. Additionally, a magnesium compound may also be present on the surface.

DETAILED DESCRIPTION OF THE INVENTION

The diaphragm herein contemplated is a synthetic diaphragm having a matrix with a contained volume of a hydrous oxide of zirconium. The matrix is fluorocarbon polymer substantially inert to the electrolyte. By fluorocarbon polymers are meant perfluorinated polymers such as polyperfluoroethylene, poly(fluorinated ethylene-propylene), and poly(perfluoroalkoxys), fluorinated polymers such as polyvinylidene fluoride and polyvinyl fluoride, and chlorofluorocarbon polymers such as chlorotrifluoroethylene and the like. Especially preferred are the perfluorinated polymers. As used herein, the term fluorocarbon polymers also encompasses those fluorocarbon polymers having active groups thereon to enhance the wettability of the substrate, e.g., sulfonic acid groups, sulfonamide groups, and carboxylic acid groups.

As herein contemplated, the internal surfaces of the fluorocarbon polymer matrix are coated with a fluorocarbon resin having pendant active sites thereon. For example, the matrix can be treated with a suitable perfluorinated resin having pendant sulfonic acid groups, pendant sulfonamide groups, pendant carboxylic acid groups, or derivatives thereof.

The matrix may be fibrous, e.g., woven fibers, or nonwoven fibers such as felts. The felts may be formed by deposition, for example, by filtration type processes or by needle punch felting processes. Alternatively, the porous matrix may be in the form of a sheet or film. The sheet or film may be rendered porous as described in British Patent No. 1,355,373 to W. L. Gore and Associates for *Porous Materials Derived From Tetrafluorethylene and Process For Their Production,* or as exemplified by Glasrock "Porex" brand polytetrafluoroethylene films.

The porous sheet or film should have a thickness of from about 10 to about 50 mils. The pore size should be from 0.8 micrometers to about 50 micrometers in diameter, and preferably from about 2 to about 25 micrometers with a size of from about 5 to about 20 micrometers being especially preferred. The porosity of the sheet or film is from about 30 to about 90 percent.

The thickness of the porous felt should be from about 0.04 to about 0.2 inch and preferably from about 0.05 to about 0.15 inch. The porosity of the porous felt should be from about 30 to about 90 percent.

The void volume of the matrix carries a hydrous oxide of zirconia, i.e., a zirconia gel. The zirconia gel has the chemical formula $ZrO \times n\ H_2O$ and is the type referred to as a hydrous zirconia gel. "n" is generally from about 2 to about 8, although substantial excesses of water may be present. Preferably, the loading of zirconia is from about 40 to about 100 grams per square foot for a mat having a thickness of about 0.06 inch, and from about 50 to about 250 grams per square foot for a mat having a thickness of about 0.12 inch. Higher loadings than those specified above may result in diminished current efficiency. In this way, the matrix contains from about 0.5 to about 250 weight percent hydrous oxides, basis matrix and hydrous oxide (anhydrous basis).

The presence of surface active or wettability enhancing moieties is admixture with the zirconia on the surface of the diaphragm produces a wettable diaphragm, especially where the matrix has pores of from about 5 to about 15 micrometers in diameter. The hydrophilic flourocarbon resin is applied to the matrix first and thereafter the zirconia is formed in the matrix.

The hydrophilic resin, i.e., a perfluorinated hydrocarbon, having pendant wettability enhancing groups such as acid groups or basic groups is provided on the surfaces of the hydrophobic perfluorocarbon substrate in order to enhance the wettability of the diaphragm.

The fluorocarbon resin having pendant acid groups is generally a copolymer of a first moiety having the empirical formula:

$$\left(CF_3-CX'X''\right)$$

and a second moiety having the empirical formula:

$$\left(CF_2-CXY\right)$$

X′ may be —F, —Cl, —H, or $CF_3$. Preferably X′ is either $-CF_3$ or F. X″ may be either —F, —Cl, —H, $-CF_3$, or $-\left(CF_2\right)_{1\ to\ 5}CF_3$. Preferably X″ is perfluorinated as F, $-CF_3$, or $-(CF_2)_{1\ to\ 5}CF_3$. Y may be either $-A$, $-\phi-A$, $-(CF_2)_{1\ to\ 10}A$, $-O-(CF_2)_{1\ to\ 10}A$, $-(O-CF_2-CF_2)_{1\ to\ 10}A$, $-(O-CF_2-CF((CF_2)_{0\ to\ 10}F))-A$, $-(O-CF_2-CF_2)_{1\ to\ 10}-(O-CF_2-CF((CF_2)_{0\ to\ 10}F))-A$, $-O-CF_2-(CF-O-CF((CF_2)_{0\ to\ 10}F))_{1\ to\ 10}-(CF_2)_{0\ to\ 10}-(O-CF_2-CF((CF_2)_{0\ to\ 10}F))-A$, or $-CF(-(CF_2)_{1\ to\ 10}F)-CF_2-O-(CF(-(CF_2)_{0\ to\ 10}F)-CF_2-O-)_{1\ to\ 3}A$, where A is the acid group and $\phi$ is an aryl group. A may be $-COOH$, $-CN$, $-COF$, $-COO(C_{1\ to\ 10}alkyl)$, $-COOM$ where M is an alkali metal or quaternary amine $-CON(C_{1\ to\ 10}alkyl)_2$, $-CONH_2$, $-SO_3H$, $(SO_3NH)_mQ$ where Q is H, $NH_4$, an alkali metal or an alkaline earth metal and m is the valence of Q, or $(SO_3)_NMe$ where Me is a cation, preferably an alkali metal, and n is the valence of Me.

According to a still further exemplification of this invention, the porous matrix can be fabricated or formed of a fluorinated hydrocarbon resin having pendant acid groups. In this way, the hydrophilic character of the acid groups can be advantageously used.

The diaphragm herein contemplated with the porous hydrophobic fluorocarbon matrix having an intermediate layer of a film of a hydrophilic fluorocarbon resin, and an outer layer of a hydrous oxide of zirconium, preferably substantially filling the remaining void volume of the matrix, is prepared by first depositing the hydrophilic fluorocarbon resin in the porous fluorocarbon matrix and thereafter depositing the hydrous oxide in the fluorocarbon matrix.

According to the method herein contemplated, the porous fluorocarbon matrix is contacted and preferably saturated with a solution containing the hydrophilic fluorocarbon resin and then the solvent is removed. The resin-treated fluorocarbon matrix may be dried further by passing air through it. Generally the amount of perfluorinated resin deposited in the matrix is from about 0.1 to about 20 weight percent, and preferably from about 0.2 to about 15 weight percent, basis weight of the porous fluorocarbon matrix.

According to one exemplification of the method of this invention, the resin may be deposited by providing a solution of the fluorocarbon resin in an organic solvent such as alcohol or in a miscible system of alcohol and water, thoroughly wetting the mat with the solution, and thereafter evaporating the solvent. Suitable organic solvents include alcohols such as methanol, ethanol, and glycols, triols, ketones, as well as organo phosphorous and organo nitrogen compounds.

The zirconium oxide gel, that is, the hydrous oxide of zirconium, is deposited in the porous matrix after depositing the resin. This may be accomplished by forming a solution of a precursor compound, for example, zirconium oxychloride, in water. This solution preferably contains up to its solubility limit of zirconium oxychloride, that is, up to about 360 grams per liter of zirconium oxychloride. The porous matrix is saturated with the solution, after which the matrix is contacted with a base. Preferably the base is a gas, for example, ammonia or anhydrous ammonia, although ammonium hydroxide may also be used. The base converts the zirconium oxychloride to the hydrous oxide of zirconium and forms ammonium chloride.

According to an alternative exemplification of this invention, a hydrous oxide of magnesium may be codeposited with the hydrous oxide of zirconium, for example, by contacting and preferably saturating the porous matrix with an aqueous solution of magnesium and zirconium compounds. Generally, the magnesium will be present in the solution as magnesium chloride while the zirconium is present in the solution as the zirconium oxychloride referred to above. After the porous matrix is contacted and preferably saturated with an aqueous solution of zirconium oxychloride and magnesium chloride, it is contacted with ammonia, as described above, whereby to hydrolyze the zirconium oxychloride and the magnesium chloride.

The precursors of the hydrous gel coatings can be deposited in various ways. For example, the solution of the precursor can be brushed or sprayed onto the porous substrate if the solution wets into the matrix. Alternatively, the porous matrix can be immersed in the solution, a vacuum drawn to remove the air from the matrix, and the vacuum released to draw solution into the matrix.

After hydrolysis and formation of the ammonium chloride, the ammonium chloride may be left in the porous matrix, for example, to be leached out by the electrolyte. Alternatively, the ammonium chloride may be leached out, the porous matrix dehydrated, and additional oxides deposited thereon, that is, additional hydrous oxides of zirconium and magnesium. In this way, hydrous oxide loadings of up to about 1.5 grams per cubic centimeter may be provided.

The diaphragms of this invention and the diaphragms made according to the method of this invention may be stored, for example, in brine or water, until ready for use.

EXAMPLE

A diaphragm was prepared by saturating a microporous poly(tetrafluoroethylene) matrix with a zirconium oxychloride solution and thereafter contacting the matrix with $NH_3$ vapor.

The matrix was a 25 mil thick Glasrock POREX P1000 poly(tetrafluoroethylene) microporous matrix having pores 10 micrometers in diameter and approximately 80 percent void volume. The matrix was treated with a 6.5 weight percent solution of DuPont NAFION® 601 polymer, a perfluorinated polymer having pendant sulfonic acid groups in ethanol. The polymer was applied to the mat by laying the mat on a flat glass plate and brushing the solution onto the mat until the mat was saturated. The saturated mat was dried in 27° C. air for 35 minutes until it appeared dry, followed by heating to 100° C. for 30 minutes to drive off any residual solvent and to anneal the coating. The mat contained 3.39 grams of resin per square foot, i.e., 10.7 weight percent resin, basis resin plus dry matrix.

The mat was then contacted with a solution of zirconium oxychloride, $ZrOCl_2$.

The zirconium oxychloride solution was prepared by adding PCR, Inc. 99 percent assay $ZrOCl_2 \times 4H_2O$ to water to obtain a 41 weight percent solution of $ZrOCL_2 \times 4H_2O$ and then diluting the solution further by adding nine parts distilled water.

The microporous matrix was then saturated with the zirconium oxychloride solution by submerging the matrix in the solution, drawing a vacuum on the submerged matrix to evacuate the air from the porous matrix, and releasing the vacuum to allow the solution to penetrate and fill the air evacuated mat. The drawing and releasing of the vacuum was repeated until there was no further uptake of solution.

The matrix was then contacted with $NH_3$ vapor for 42 hours to hydrolyze the chloride and then stored in distilled water.

Thereafter the mat was tested as a diaphragm in a laboratory diaphragm cell. With a 0.16 inch (4.1 millimeter) anode to cathode gap, a ruthenium dioxide coated titanium mesh anode and a perforated steel plate cathode, the head was 3 to 6 inches, the average cell voltage was 3.02 to 3.07 volts at a current density of 190 Amperes per square foot, and the cathode current efficiency was 93 percent.

While the invention has been described with reference to specific exemplifications and embodiments thereof, the invention is not limited except as in the claims appended hereto.

I claim:

1. In a method of preparing a diaphragm comprising depositing a hydrous oxide of zirconium in a porous, hydrophobic fluorocarbon matrix, the improvement comprising first depositing a hydrophilic fluorocarbon resin on the surface of the porous fluorocarbon matrix and thereafter depositing the hydrous oxide in the fluorocarbon matrix.

2. The method of claim 1 wherein the hydrophilic fluorocarbon resin is a perfluorinated hydrocarbon having pendant acid groups.

3. The method of claim 2 wherein the pendant acid groups are chosen from the group consisting of —$SO_3H$, —COOH, and derivatives thereof.

4. The method of claim 1 comprising contacting the fluorocarbon body with a solution containing the hydrophilic fluorocarbon resin and removing the solvent.

5. The method of claim 1 comprising depositing from about 0.1 to about 20 weight percent hydrophilic resin, basis weight of the porous fluorocarbon body.

6. A diaphragm for a chlor-alkali electrolytic cell comprising:

a porous, hydrophobic, fluorocarbon matrix;

a film of a hydrophilic fluorocarbon resin on the surfaces of the porous matrix; and a hydrous oxide of zirconium atop the hydrophilic fluorocarbon resin in the porous matrix.

7. The diaphragm of claim 6 wherein the hydrophilic fluorocarbon resin is a perfluorinated hydrocarbon having pendant acid groups.

8. The diaphragm of claim 7 wherein the pendant acid groups are chosen from the group consisting of —COOH, —$SO_3H$, and derivatives thereof.

9. The diaphragm of claim 6 wherein the diaphragm contains from about 0.5 to about 250 weight percent hydrous oxide of zirconium and from about 0.1 to about 20 weight percent hydrophilic resin, basis weight of the porous, hydrophobic fluorocarbon matrix.

10. The diaphragm of claim 6 wherein said diaphragm contains magnesium oxide and a hydrous oxide of zirconium atop the hydrophilic fluorocarbon resin.

* * * * *